United States Patent [19]

Muylle

[11] Patent Number: 4,537,306

[45] Date of Patent: Aug. 27, 1985

[54] RADIOGRAPHIC FILM PACKAGE

[75] Inventor: Wilfried E. Muylle, Schoten, Belgium

[73] Assignee: AGFA-Gevaert N.V., Mortsel, Belgium

[21] Appl. No.: 626,483

[22] Filed: Jul. 3, 1984

Related U.S. Application Data

[63] Continuation of Ser. No. 428,807, Sep. 30, 1982, abandoned, which is a continuation of Ser. No. 246,107, Mar. 20, 1981, abandoned.

[30] Foreign Application Priority Data

Mar. 25, 1980 [DE] Fed. Rep. of Germany ... 8008205[U]

[51] Int. Cl.[3] ..... B65D 85/48

[52] U.S. Cl. ..... 206/455

[58] Field of Search ..... 206/455, 484

[56] References Cited

U.S. PATENT DOCUMENTS

| | | | |
|---|---|---|---|
| 3,749,238 | 7/1973 | Taylor | 206/484 |
| 3,775,239 | 11/1973 | Snow | 206/484 |
| 3,958,693 | 5/1976 | Greene | 206/455 |
| 4,108,308 | 8/1978 | Franke et al. | 206/455 |
| 4,147,291 | 4/1979 | Akao et al. | 206/455 |
| 4,158,409 | 6/1979 | Duinker | 206/455 |

*Primary Examiner*—Joseph Man-Fu Moy

*Attorney, Agent, or Firm*—William J. Daniel

[57] ABSTRACT

A radiographic film package for non-destructive testing, comprising a radiographic film sheet, an intensifying screen with a layer of lead bonded to a paper foil, and a vacuum heat-sealed wrapper with a layer of aluminium and a heat-sealable easy-peelable thermoplastic layer.

7 Claims, 5 Drawing Figures

RADIOGRAPHIC FILM PACKAGE

Figure 1:
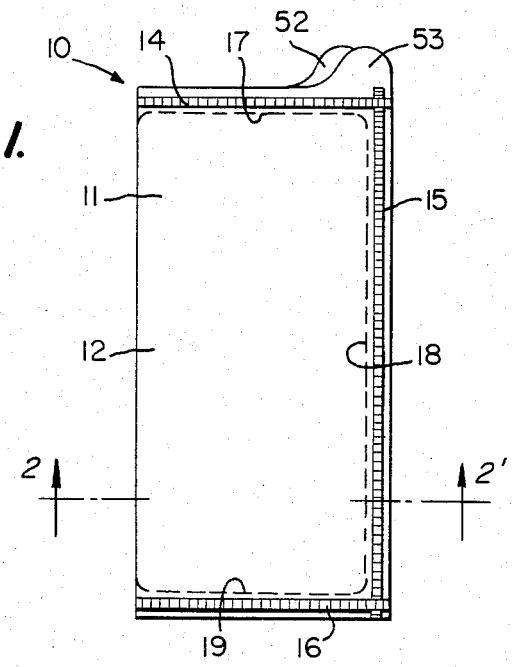

This application is a continuation of application Ser. No. 428,807, filed 9/30/82, which is also a continuation of application Ser. No. 246,107, filed 3/20/81, all now abandoned.

The present invention relates to a radiographic film package for non-destructive testing comprising a radiographic film sheet and a light-tight wrapper around said film sheet.

Film packages of the described type are known as "DW film", i.e. double wrapped film, since a plurality of equal film packages are packed together in a second package, for instance a cardboard box. The mentioned film packages are used on a large scale for the radiographing of industrial objects, such as the weld seams of pipelines.

Known film packages comprise a radiographic film sheet, an inner wrapper around said film sheet with a layer of lead that is in contact with the film sheet on at least one side of the film sheet thereby to operate as an intensifying screen, and an outer wrapper around the inner wrapper which is light-opaque and which has a heat-sealable thermoplastic layer at the inner side of the package.

A disadvantage of known film packages is the presence of air in the film package. This internal air causes local air cushions whereby some distance may be created between the film and lead intensifying screens incorporated in the package.

This internal air further makes the package behave as a three-dimensional hollow body that is subjected to buckling load at its side that is concavely curved in use. The latter situation notably occurs in applications where the film package is bent around a curved object in order to make an exposure, as for example in the case of the examination of peripheral seams or pipelines. The buckling of the concave side of the film package will create local areas of contact between the film and the corresponding lead screen, as well as local areas of separation of several tenths of a millimeter between the film and the screen. Any separation between the film and the screen reduces the image sharpness and the image contrast but, unfortunately, such reduction cannot always be readily recognized in the absence of a test pattern.

It has been proposed to improve the contact between the film and the intensifying screens by packaging the film under vacuum. An example of vacuum packaged radiographic films for non-destructive testing is disclosed in the German Utility Model No. 7,902,283.6 filed Jan. 27, 1979 by Agfa-Gevaert N.V. It has been shown that the vacuum achieved by these packages is not sufficiently long lasting and it is believed that the main cause for said deficiency is formed by the ribbon of adhesive that is applied on the margins of the lead layer of the package in order to seal the package. This package further has a reduced stiffness whereby difficulties arise in handling the package during automatic manufacturing of thereof.

It is the aim of the present invention to provide an improved package for radiographic film for non-destructive testing, that is readily manufactured and that offers an excellent contact between the film and the lead screen, even after prolonged periods, that may last, for instance to at least one year after the date of manufacture of the package.

According to the invention, a radiographic film package for non-destructive testing, comprising a radiographic film sheet, a foil wrapper with a layer of lead that is in contact with the film sheet and a light opaque around said film sheet and said foil and which has a heat-sealable thermoplastic layer at the inner side of the package, is characterized in that the wrapper is air-tight, it comprises a layer of aluminium, and is heat-sealed under vacuum to complete the package.

Preferred but optional features of a film package according to the invention are as follows.

The wrapper has an exterior polyethylene terephthalate layer, the layer of aluminium being located between the polyethylene terephthalate layer and the heat-sealable thermoplastic layer, and the layer of aluminium has been formed by vacuum deposition of aluminium on the polyethylene therephthalate layer. This composition provides a tear-resistant wrapper, the outer side of which is protected against mechanical damaging by bending or rubbing, by the heat-sealing of the package, etc.

The heat-sealable thermoplastic layer of the wrapper at the inside of the package is arranged in such a way that the wrapper may easily be peeled open, by separating a surface stratum only of said thermoplastic layer. In the mentioned way, one may dispense with the usual tear-strip for opening the package. It has been shown that the provision of a tear-strip may give rise to considerable problems in connection with a satisfactory vacuum-tight sealing of the package.

The polyethylene terephthalate layer at the outer side of the wrapper is preferably transparent. In the mentioned way, the aluminium layer forms a surface with a highly reflective power whereby absorption of IR radiation by the package and resultant heating of the contents is minimized. The latter aspect is notably important for use of the film packages in the field, such as in the examination of pipelines, where direct sunlight may cause a rise of the inside temperature of the package to an unacceptable level.

The opening of the package is facilitated when at least one corner of the package is provided with two ears. If the contours of said ears are not congruent, the gripping of the ears may become more easy.

Figure 2:
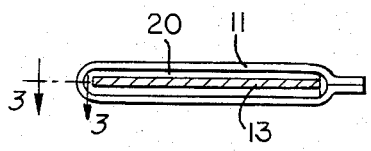
Figure 3:
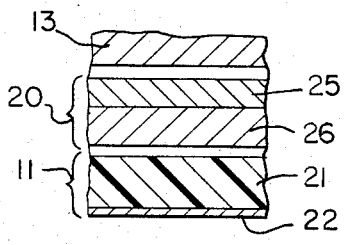
Figure 4:
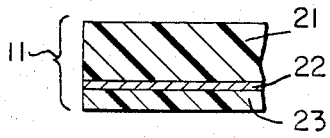
Figure 5:
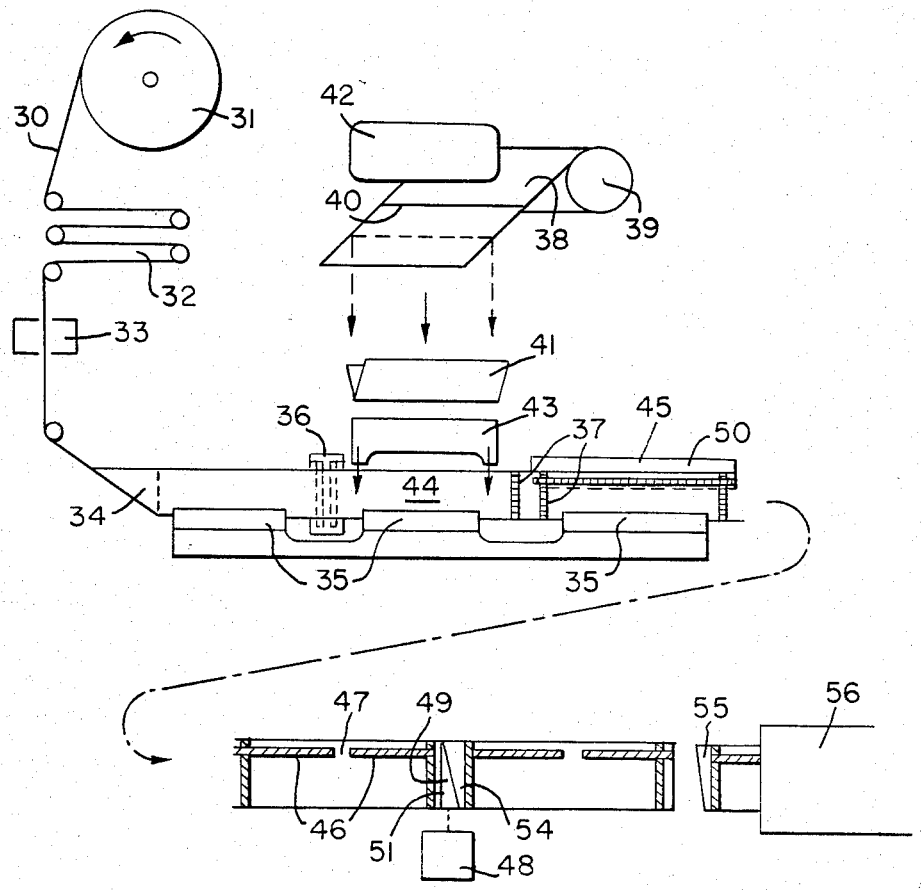

The invention is described hereinafter by way of example with reference to the accompanying drawings wherein:

FIG. 1 is a plan view of the package according to one embodiment of the invention, and FIG. 2 is a section on line 2—2' of FIG. 1, FIG. 3 is a view on an enlarged scale of detail 3 of FIG. 2, FIG. 4 is a view of another embodiment of the wrapper of the package, and FIG. 5 illustrates diagrammatically one embodiment of a packaging machine for the manufacturing of a package according to the invention.

Referring to FIGS. 1 and 2, a film package 10 comprises a wrapper 11 folded on a line 12 about a radiographic film sheet 13, and sealed on three margins 14, 15 and 16 while under vacuum. As a consequence of the sealing under vacuum, the contour of the film sheet 13 is clearly visible on the outer surface of the wrapper, and the broken lines 17, 18 and 19 represent in fact the outline of the film sheet on the outer side of the wrapper as it may be observed by the naked eye. A distance of approximately 2 to 5 mm may exist between the outlined edges of the film sheet 13 and the sealed margins 14, 15 and 16.

The distance between the edge of the film sheet and the corresponding fold 12 of the wrapper 11 is determined by the thickness of the foil 20 which is folded about the film. The free edges of the foil 20 preferably coincide with the film edges on the lines 17, 18 and 19.

The purpose and the composition of the wrapper 11 and the foil 20 are now described with reference to FIG. 3 wherein the successive distances between the film, the foil and the wrapper, which distances actually are zero, have been illustrated as amounting to a certain value for the sake of clearness.

The purpose of the wrapper 11 is to constitute an air-tight and light-tight envelope for the film. Said wrapper consists of light-opaque thermoplastic foil 21 which readily lends itself to heat-sealing, e.g. black pigmented polyethylene, and an aluminium layer 22 at the outer side of the said foil. The heat-sealing may occur in a known way by means of pairs of heated bars between which the wrapping foil is clamped.

The aluminium layer 22 improves the air imperviousness of the wrapper and at the same time it may form an effective IR reflective layer as mentioned in the introduction of the specification.

The wrapper 11 may be arranged in such a way that heat-sealing of the wrapper produces a bond between the opposed layers of the wrapper, which is slightly less strong than the tear strength of the thermoplastic material. The advantage of this feature is that the package may be opened by peeling the sealed wrapping foil sections from each other, without need to tear the thermoplastic foil 21 over its complete thickness.

One such arrangement of the wrapper 11 may be based on a thin layer 23 of an appropriate resin coated on the free surface of the foil 21.

Another arrangement may be formed by a thermoplastic foil 21 that is in fact a laminate of two or more sublayers. The heat-sealing bond of the package then affects only the outer layer of the laminate, whereas the opening of the package may be based on the rupturing of the bond between intermediate layers of the thermoplastic foil itself.

Still another arrangement may be based on a heat-sealable thermoplastic foil 21 wherein suitable additives have been added to the thermoplastic component(s) to reduce the bonding strength obtained by heat-sealing while, however, yet not reducing the bonding strength to such a proportion that satisfactory vacuum sealing would become problematic.

The wrapper 11 may be provided with two ears, such as the ears 52 and 53 provided on two coinciding corners of the wrapper, in order to facilitate the opening of the package. The ears 52 and 53 can easily be grasped by the operator, especially when the contours of the ears do not coincide with each other as illustrated in FIG. 1, and as they are pulled away from each other, the film package is progressively opened. The described technique for opening the package avoids the disadvantages that are related with a tear-strip.

Another embodiment of the wrapper 11 is illustrated in FIG. 4. It may be seen that the wrapper is in fact a laminate of three layers, namely a layer 21 which is a heat-sealable layer and a layer 22 which is a metal layer as in the embodiment of FIG. 3, and a layer 23 which is a polyethylene terephthalate layer. The mentioned wrapper composition shows a greater tear strength than that of the FIG. 3 illustration, and the polyethylene terephthalate layer 23 at the outer side of the wrapper ensures moreover an adequate protection of the aluminium layer 22. Suitable thicknesses of the respective layers of the wrapper 11 are (approximately) 10 μm for the layer 23, 1 to 3 μm for the layer 22, and 25 to 50 μm for the layer 21. The aluminium layer 22 may suitably be formed by vacuum deposition of aluminium on a polyethylene terephthalate foil, and by subsequently laminating or adhering a polyethylene foil 21 to the aluminium layer.

The purpose of the foil 20 is to provide an image intensifying screen for the radiographic film, and also to increase the stiffness of the film package. The foil 20 consists of a layer of lead 25 which is bonded to a paper support 26. The term "lead" should not be interpreted as strictly limitative, and thus itensifying screens of lead alloys such as antimony-lead, are as well within the scope of this definition. The paper support 26 is a quite cheap element that yet imparts to the film package the required mechanical stiffness. Paper support 26 may be pigmented to improve the light-tightness of the package.

It has been shown that a film package as described hereinbefore could be bent to a radius up to 5 cm without any tendency to buckle or to deform otherwise. There was a very firm contact between the film and the screens so that excellent image sharpness and contrast were obtained.

It was shown that the package vacuum lasted periods longer than one year. It was further shown that the vacuum retention of the film packages was improved by wrapping a number of the packages together, for instance ten packages at a time, in a second, common package that was likewise sealed under vacuum. The opening of the packages by means of two ears rather than by a conventional tear-strip could be done very easily as a consequence of the particular arrangement of the outer wrapper, whereby a seal was obtained that was sufficiently strong to maintain the vacuum in the package, and yet sufficiently weak to permit the opening of the package without rupturing the outer wrapping foil through its complete thickness, or even the thermoplastic heat-sealable layer through its complete thickness.

FIG. 5 illustrates one embodiment of a packaging machine for the manufacturing of film packages according to the invention.

A web 30 of wrapping material is drawn from a roll 31. A web tensioner 32 ensures the required longitudinal tension in the web. A transverse cutter 33 makes a transverse cut at regular intervals whereby the ears for the opening of the package are formed. The web is not completely transversely severed, so that the transport of the web may uninterruptedly go on. The web is then passed through a folding device 34 where it is folded longitudinally on its centre line. Transport clamps 35 engage the folded edge of the web and ensure the further transport.

At regular intervals a transverse sealing device 36 produces two parallel transverse strip seals such as 37, that form each time the trailing and the leading seals of a package.

A web 38 consisting of a layer of lead adhered to a layer of paper, the layer of lead being on the upper side of the web in the representation of FIG. 5, is drawn from a roll 39 and cut into foils on a line such as the line 40 shown. A cut foil is folded as illustrated at the position 41 and a sheet of radiographic film 42 is inserted by means, not shown, into the folded foil 41. The dimensions of the foil are such that the top and the side edges of the film sheet 42 coincide with the corresponding edges of the folded foil 41. The lower edge of the film sheet 42 rests in the inside edge of the fold in the foil 41.

A feed mechanism 43 takes the successively wrapped film sheets and inserts each time one wrapped film sheet into a pocket 44, open at the top side, which is formed by the folded wrapper 30 and successive transverse seals 37.

The next step in the manufacture of the packages is performed by the sealing station 50 which produces the longitudinal heat seal 46 of the package. This seal has an interrupted zone 47 at its centre, and the interruption forms in fact the only opening through which the interior of the package is still in communication with the environment air after leaving station 50.

A transverse cutter 48 cuts out and removes the section of the wrapper 30 with a configuration as indicated by the numeral 49 that is situated between the successive packages, so that the straight front edge 51 of the left-hand package and the slanting trailing edge 54 of the right-hand package, according to the lower half of FIG. 5, are formed.

The ears 55 that are formed by the slanting cuts 54 coincide with each other, and have a trapezoidal shape, extending over the complete width of the packages. Said form of the ears can be more readily produced than that of the ears 52, 53 of FIG. 1, and it has been shown that the described trapezoidal shape contributes in a favourable way to the easy gripping and separation of the coinciding ears by an operator.

The packages are than transferred into a vacuum sealing station 56. This station is arranged for sealing the zone 47 of a package while the package is maintained at an underpressure of, for instance, 1 kPa.

The finished packages have an appearance as the package illustrated in FIG. 1, except for the seal 15 which may undergo a slight widening about half-way its length, resulting from the seal which was made in the station 56 in order to close the zone 47 of the longitudinal edge of the package, and for the trapezoidal form of the ears.

The packages may finally be wrapped in groups in a second vacuum package as described hereinbefore.

The vacuum sealing of the packages may be done in an other way than the one illustrated in FIG. 5, for instance by producing the longitudinal seal 46 of the package in one operation over the complete length of the package while the package is at reduced environment pressure.

The packages may have a square form, or a rectangular form wherein the ratio between the length and the width of the package is much greater than that shown in the drawing. For instance, the packages may have a width down to 10 cm and a length up to 100 cm.

The packages may be provided with identification data, that may be individually printed on each finished package, or that may be already provided at regular intervals that are shorter than the length of one package, in the wrapper 30 that is unwound from a roll 31.

A package in accordance with the invention may also be produced by using two outer wrapping foils that are sealed to each other on the four margins, rather than using one foil cut from a web that is folded about the package and that consequently needs three seals only as described hereinbefore.

The web 38 may be replaced by two webs of equal composition having each a width equal to the width of the radiographic film sheet, and that are unwound and cut in such a way that two foils are produced that are each with a layer of lead in contact with one side of the radiographic film sheet.

We claim:

1. In a flat, air-tight, evacuated radiographic film package for non-destructive testing which comprises: a radiographic film sheet, a foil sheet comprising a layer of lead in contact with at least one side of the film sheet, and a light-opaque laminated wrapper extending over both sides of said film sheet and foil sheet with said film and foil sheets sandwiched therebetween, said laminated wrapper comprising an inner layer of a heat-sealable peel-strippable thermoplastic, and an outer protective layer of a generally transparent polymer, with the two sides of said wrapper being air-tightly sealed around the open edges thereof by heat-sealing together the mutually facing inner thermoplastic layers in the margins of said wrapper sides proximate said edges while the interior of said wrapper is under vacuum, the improvement wherein said laminated wrapper includes an intermediate layer of aluminum vacuum deposited upon the inner face of said outer protective layer.

2. The film package of claim 1, wherein said inner thermoplastic layer contains black pigment.

3. A radiographic film package according to claim 1, characterized in that the wrapper is formed from a single sheet of said laminate folded along its longitudinal axis around one edge of the film and foil and heat-sealed along its remaining edge margins.

4. A radiographic film package according to claim 3, characterized in that said package comprises near at least one corner opposite to the folded edge, two ears for facilitating the opening of the package.

5. A radiographic film package according to claim 4, characterized in that said ears are formed by trapezoidal-like extensions (55) of the wrapper at the outer side of a transverse seal of the package.

6. A radiographic film package according to claim 3, characterized in that said ears are disposed in non-registering relation.

7. The package of claim 1, wherein said wrapper is formed of two separate sheets, one on each side of the sandwich of said film sheet and said foil sheet, and is heat-sealed in the margins of its four side edges.

* * * * *